US005519375A

United States Patent [19]

Ashibe et al.

[11] Patent Number: 5,519,375

[45] Date of Patent: May 21, 1996

[54] SOUND GENERATOR

[75] Inventors: Yasue Ashibe; Tadaharu Asanuma, both of Saitama, Japan

[73] Assignee: Rhythm Service Co., Ltd., Saitama, Japan

[21] Appl. No.: 298,588

[22] Filed: Aug. 30, 1994

[30] Foreign Application Priority Data

Jul. 7, 1994 [DE] Germany ..... 9410847 U

[51] Int. Cl.[6] ..... G08B 3/00

[52] U.S. Cl. ..... 340/392.5; 340/392.1; 340/392.4; 340/398.2

[58] Field of Search ..... 340/384.7, 384.71, 340/392.1, 393.1, 393.4, 401.1, 398.2, 392.4, 392.5, 395.1, 396.1; 116/156, 148, 150, 152

[56] References Cited

U.S. PATENT DOCUMENTS

| | | | |
|---|---|---|---|
| 1,924,395 | 8/1933 | Bossard | 340/392.4 |
| 2,177,515 | 10/1939 | Bossard | 340/392.4 |
| 2,219,036 | 10/1940 | Mason | 340/392.4 |
| 2,254,488 | 9/1941 | Miller | 340/392.4 |
| 2,265,815 | 12/1941 | Rittenhouse | 340/392.5 |
| 2,466,640 | 4/1949 | Gardes | 340/392.4 |
| 4,247,933 | 1/1981 | Nakamura | 368/269 |
| 4,286,259 | 8/1981 | Ishii . | |
| 4,357,692 | 11/1982 | Broghammer et al. | 368/75 |
| 4,358,838 | 11/1982 | Nakamura | 368/75 |

*Primary Examiner*—Brent A. Swarthout

*Attorney, Agent, or Firm*—Lowe, Price, LeBlanc & Becker

[57] ABSTRACT

A gong holder is secured to a resonance box. A first end of each of gong sticks is secured to the gong holder. Solenoid type hammer devices drive rod hammers that are movably disposed in a direction perpendicular to the gong sticks so that the rod hammers strike the gong sticks. Thus, real chime sound is accomplished. In addition, since the hammer devices do not associate with mechanical parts such as cams, the size of the hammer devices can be decreased and the degree of freedom of the installation thereof can be increased.

4 Claims, 4 Drawing Sheets

SOUND GENERATOR

BACKGROUND OF THE INVENTION

1. Field of the Invention

The present invention relates to a sound generator for use with music boxes, chimes, time tone generating devices of clocks, and so on.

2. Description of the Related Art

In conventional sound generators, a sounding member is stricken by a hammer jointed to a cam driven by a motor. In a sound generator for a hall clock what is called "Grandfather" having a time tone generating function such as a Westminster chime, gong sticks with different lengths for different tones are secured to a gong holder made of cast iron. By striking a fixed end portion of a gong stick with a hammer device, a predetermined melody and a time tone is generated. In the hammer device, the number of striking times is determined by the position of a pin that is in contact with a counter cam that moves in association with a hour wheel. By rotating a time tone generating cam, the hammer device is mechanically driven.

Unlike with the above-described mechanical sound generator, another sound generator that electronically generates similar sound tones is known.

However, in the electronic sound generator, although tones can be artificially generated, real chime sound cannot be generated.

Moreover, in the conventional mechanical sound generators, a plurality of cams and hammer devices driven in association therewith are required. Thus, the size of the final products will increase and the position of the sound generator should be disposed near the cams.

SUMMARY OF THE INVENTION

The present invention is made to solve such a problem. An object of the present invention is to provide a sound generator that generates tones of real gong sticks having small hammer devices with high degree of freedom of installation.

The sound generator according to the present invention comprises a gong holder secured to a resonance box, a gong stick having a first end and a second end, the first end being secured to the gong holder, the second end being a free end, and a hammer device for striking the gong stick, characterized in that the hammer device comprises a rod hammer movably disposed in a direction perpendicular to the gong stick, a solenoid member for driving the rod hammer, and a current source means for supplying current to the solenoid member.

According to the present invention, the hammer devices that strike the gong sticks are of solenoid type. The rod-shaped hammers are driven by the solenoid members in the direction perpendicular to the corresponding gong sticks so as to generate corresponding tones. Thus, real tones of gong sticks are generated. In addition, since the hammer devices are not jointed with mechanical members such as cams, the size of the hammer devices can be decreased and the degree of freedom of installation thereof can be increased.

These and other objects, features and advantages of the present invention will become more apparent in light of the following detailed description of a best mode embodiment thereof, as illustrated in the accompanying drawings.

DESCRIPTION OF PREFERRED EMBODIMENTS

Next, with reference to the accompanying drawings, embodiments of the present invention will be described.

Figure 1:
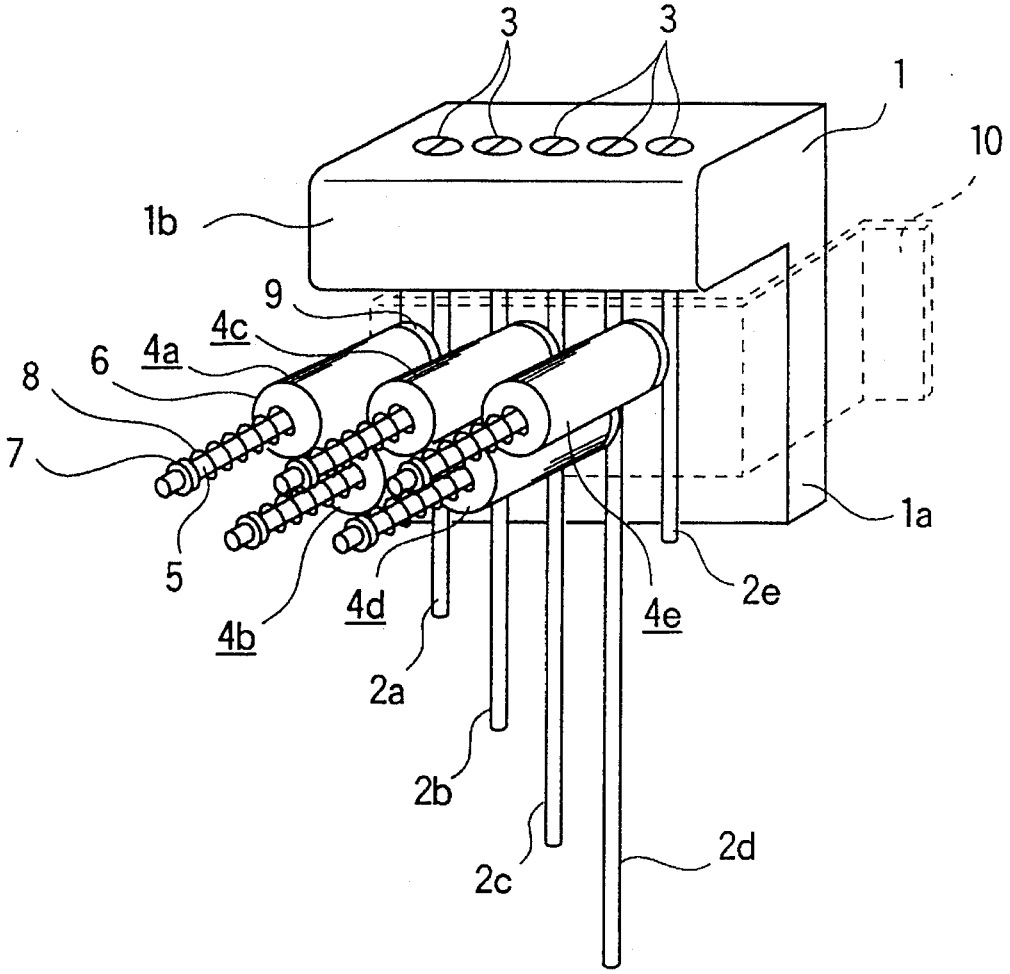
FIG. 1 is a perspective view showing principal portions of a sound generator according to an embodiment of the present invention.

FIG. 1 is a schematic diagram showing a construction of a sound generator according to the present invention.

In FIG. 1, reference numeral 1 is a gong holder that is made of die-cast gray iron or the like. The gong holder 1 is constructed of a flange portion 1*a* and a protrude portion 1*b* that vertically protrudes from the lower surface of the flange portion 1*a*. The gong holder 1 is secured to an inner surface of a wooden frame such as a hall clock (not shown) through the flange portion 1*a*. An end portion of each of for example five gong sticks 2*a*, 2*b*, 2*c*, 2*d*, and 2*e* is secured to the protrude portion 1*b* of the gong holder 1 by a screw 3. The gong sticks 2*a* to 2*e* are made of for example iron or phosphor bronze and aligned on the gong holder 1. The gong sticks 2*a* to 2*e* have different lengths for corresponding tones. The other end of each of the gong sticks 2*a* to 2*e* is a free end.

Hammer devices 4*a*, 4*b*, 4*c*, 4*d*, and 4*e* are opposed to the gong sticks 2*a*, 2*b*, 2*c*, 2*d*, and 2*e*, respectively, on the gong holder 1 side. Each of the hammer devices 4*a* to 4*e* is constructed of a rod hammer 5, a solenoid member 6, a rib 7, a spring 8, and a cushioning member 9. The rod hammer 5 is made of a magnetic material and is movable in a direction perpendicular to the alignment direction of the corresponding gong stick. The solenoid member 6 is disposed around the rod hammer 5. The solenoid member 6 tensions the rod hammer 5 in forward direction. The rib 7 is disposed at an end portion of the rod hammer 5. The spring 8 is disposed between a rear end portion of the solenoid member 6 and the rib 7. The spring 8 always tensions the hammer rod 5 in backward direction. The cushioning member 9 is made of felt. The cushioning member 9 is disposed at the front end portion of the solenoid member 6. The cushioning member 9 prevents the rod hammer 5 from rebounding from the corresponding gong stick.

The hammer devices 4*a* to 4*e* may be aligned. However, if the hammer devices 4*a* to 4*e* are disposed in a zigzag pattern, the space thereof can be reduced. The hammer devices 4*a* to 4*e* are secured to an inner surface of a wooden frame (not shown) by a support member 10. The support member 10 has for example a frame shape.

Figure 2:
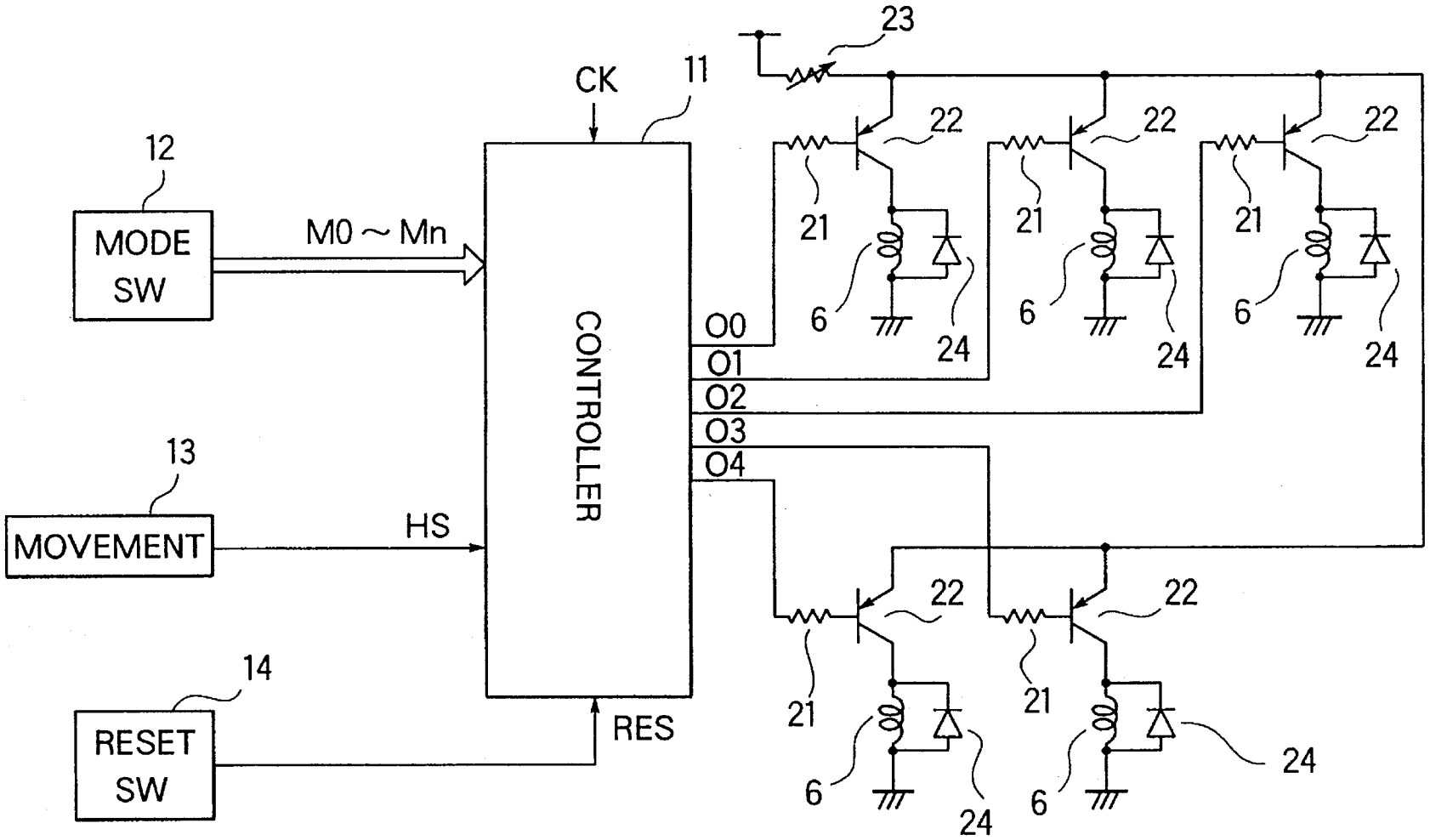
FIG. 2 is a schematic diagram showing a circuit construction of the sound generator of FIG. 1.

FIG. 2 is a schematic diagram showing a sound control circuit that supplies current to the hammer devices 4*a* to 4*e*. This circuit is used for a striker of a clock.

In FIG. 2, reference numeral 11 is a controller. The controller 11 sets modes with mode signals M0 to Mn corresponding to music programs, time tone range, or the like that are designated by a mode switch 12. When the controller 11 receives a time tone start signal HS from a movement 13 of a clock (quartz) every 1 hour, 30 minutes, or 15 minutes, the controller 11 outputs sound signals O0, O1, O2, O3, and O4 corresponding to the designated mode. The sound signals O0 to O4 are supplied to respective bases of transistors 22 through registers 21. The transistors 22 supply respective collector current to the solenoid coils 6 of the hammer devices through variable resistors 23 that can vary sound volume. Thus, the hammer devices 4*a* to 4*e* are selectively tensioned and the corresponding gong sticks 2*a* are stricken. At this point, diodes 24 that are reversely connected in parallel with the respective solenoid coils 6 prevent over-voltage from flowing at both ends thereof. A reset switch 14 is used to initialize the controller 11.

When the controller 11 is constructed of a microcomputer, a microprogram stored in an ROM (not shown) of the microcomputer is activated with the time tone start signal HS so as to generate sound signals. The mode signals M0 to Mn designate a start address of a microprogram to be selected.

Figure 3:
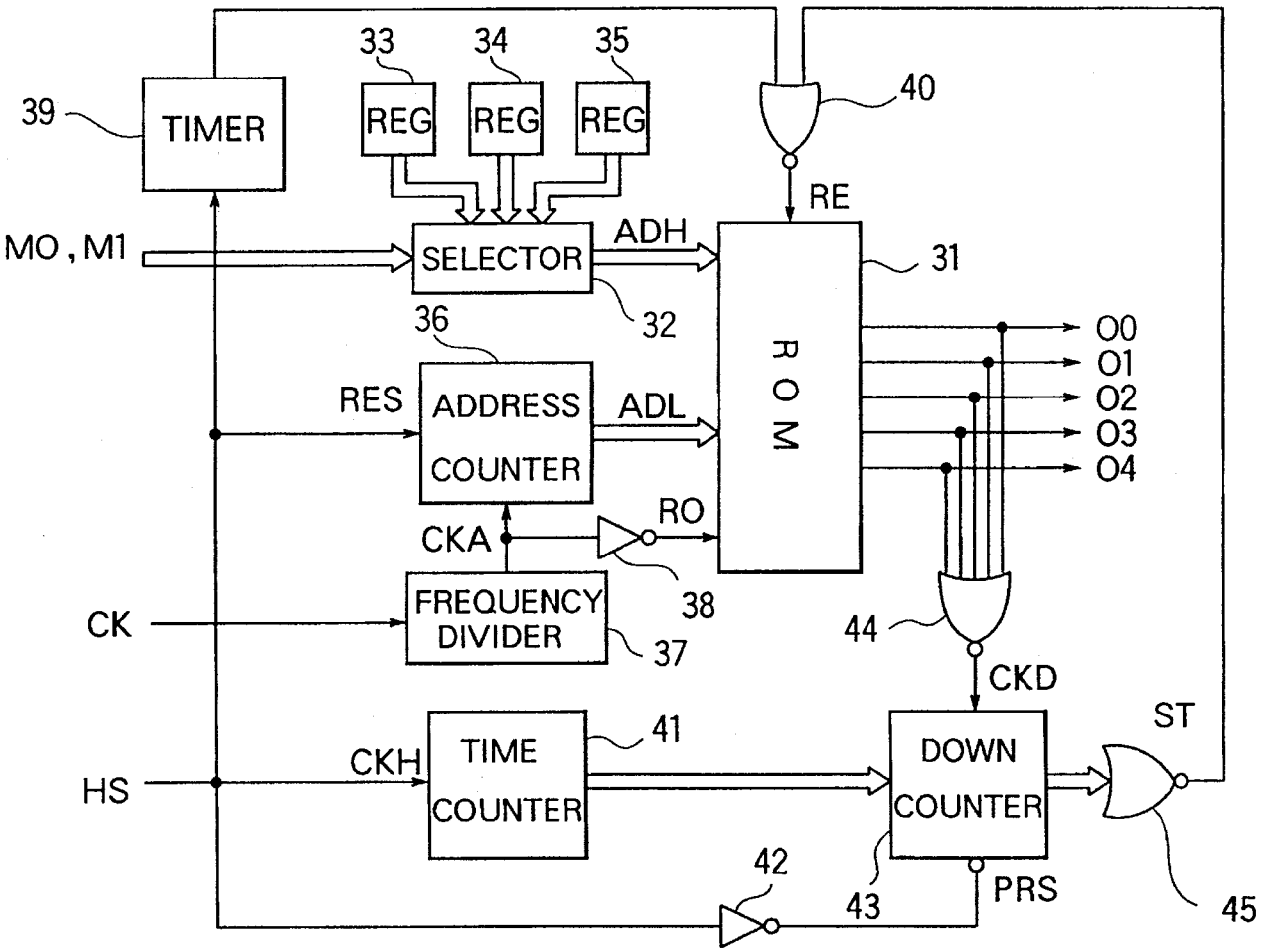
FIG. 3 is a block diagram showing a construction of a control circuit of the sound generator of FIG. 1.

When the control circuit is constructed of hardware, the construction will be as shown in FIG. 3.

In FIG. 3, a ROM 31 stores time sequence data of sound signals O0 to O5 corresponding to a plurality of music programs. A selector 32 selects information representing a high order address of a location where information of a music program designated with the mode signals M0 and M1 is stored from a plurality of registers 33, 34, and 35. The registers 33, 34, and 35 output a high order address ADH to the ROM 31. An address counter 36 is reset with the time tone start signal HS. The address counter 36 counts pulses of an address clock CKA where the frequency of a reference clock CK is divided by a frequency divider 37. The address counter 36 outputs a low order address ADL to the ROM 31. An address clock CKA determines the tempo of a time tone (namely, the read interval of the ROM 31), and is supplied to the ROM 31 through an inverter 38 as a read out signal RO.

When the time tone start signal HS is supplied to the timer 39, the output signal thereof becomes low for 1 to 2 minutes. This signal is supplied to a NOR gate 40. The NOR gate 40 outputs a read enable signal RE to the ROM 31.

The time tone start signal HS supplied to a time counter 41 as a time count clock CKH. The time counter 41 counts 1 to 12 every hour. An output of the time counter 41 is preset to a down-counter 43 with an output signal of an inverter 42 in which the time tone start signal HS is supplied. A NOR gate 44 detects a time tone following a chime sound [namely, a sound signal where all sound signals O0 to O5 become active (L level)]. The down-counter 43 counts an output signal of the NOR gate 44. When the value of the down-counter 43 becomes 0, it outputs a sound stop signal ST through a NOR gate 45. The sound stop signal ST is supplied to a NOR gate 40. The NOR gate 40 outputs a read enable signal RE to the ROM 31.

Figure 4:
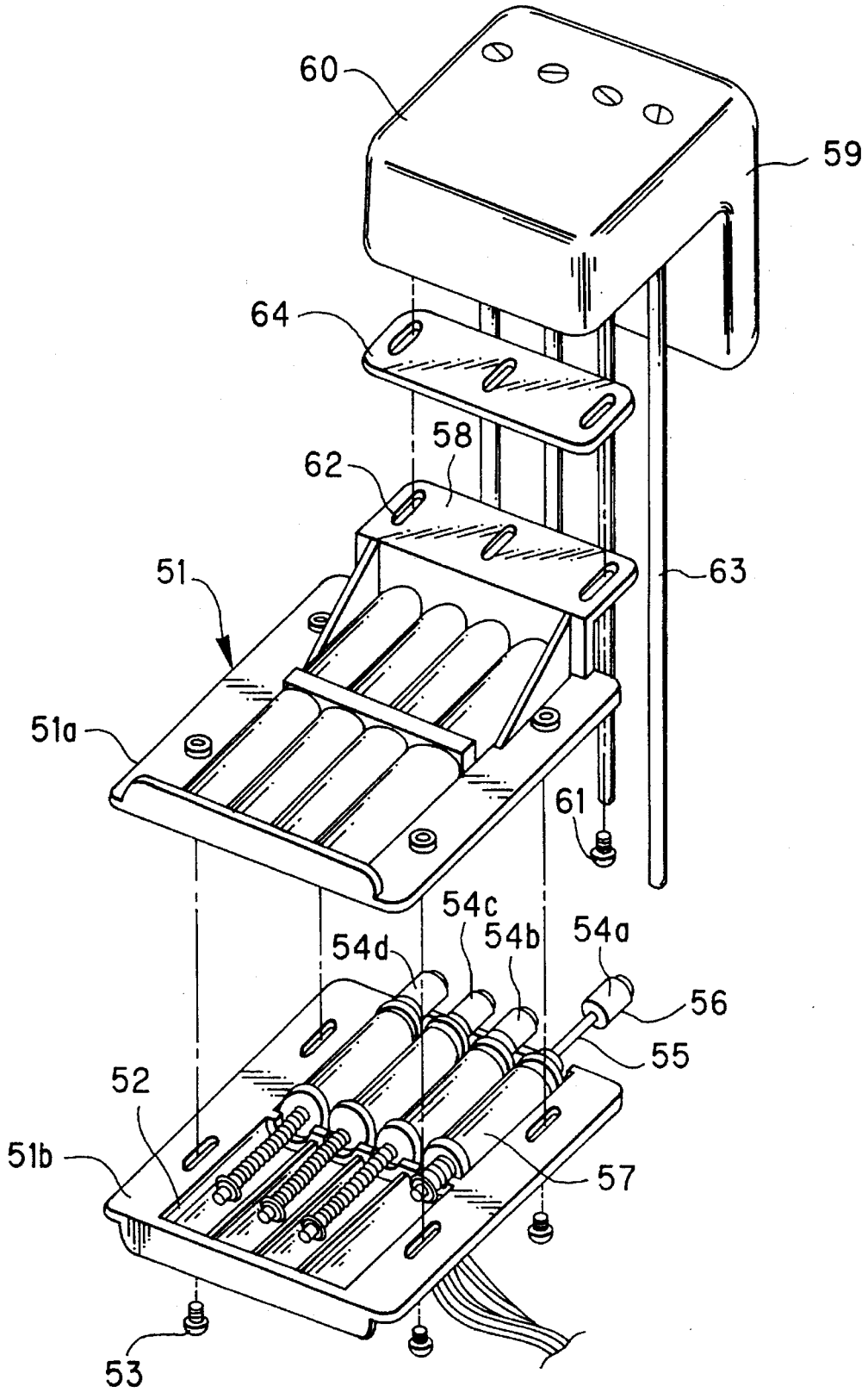
FIG. 4 is a perspective view showing principal portions of a sound generator according to another embodiment of the present invention.

FIG. 4 is a perspective view showing a sound generator according to another embodiment of the present invention. In this embodiment, hammer devices are mounted on a gong holder. In FIG. 4, reference numeral 51 is a case. The case 51 is made of plastics and constructed of an upper lid 51*a* and a lower lid 51*b*. Each of the upper lid 51*a* and the lower lid 51*b* has four grooves 52. When the upper lid 51*a* and the lower lid 51*b* are connected with screws 53, the grooves 52 form four cylindrical cavity portions where hammer devices 54*a*, 54*b*, 54*c*, and 54*d* are accommodated. When solenoid coils 57 are not energized, respective front end portions 56 of rod hammers 55 slightly protrude from the case 51. A flange 58 is formed on the upper lid 51*a*. The flange 58 is disposed at front end portions 56 of the rod hammers 54 and extends along the rod hammers 54. The flange 58 is secured to the lower surface of a protrusion portion 60 of a gong holder 59 with screws 61. Long holes are formed on the flange 58. Thus, since the distance between the flange 58 and the gong holder 59 can be adjusted, the distance between the front end portions 56 of the hammer devices 54*a* to 54*d* and corresponding gong sticks 63 can be adjusted. A cushioning spacer 64 is disposed between the flange 58 and the lower surface of the protrusion portion 60 of the gong holder 59. The cushioning spacer 64 is made of rubber or the like. The cushioning spacer 64 prevents vibration of the gong sticks 63 from being transmitted to the hammer devices 54*a* to 54*d*.

Figure 5:
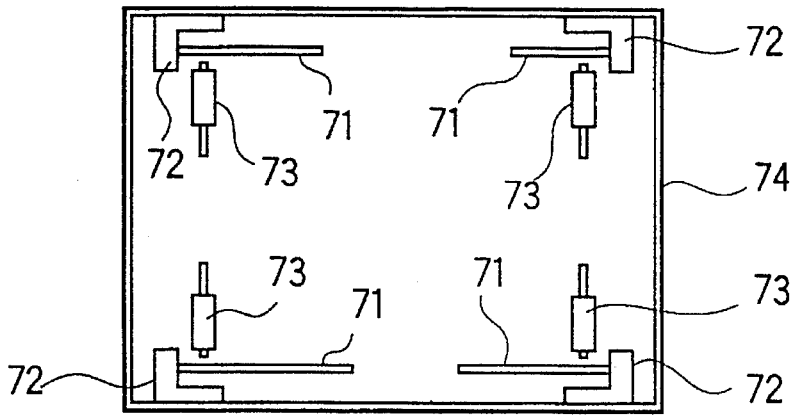
FIG. 5 is a schematic diagram showing a construction of a sound generator according to a further embodiment of the present invention.

In the above-described embodiments, a plurality of gong sticks are secured to a common gong holder. However, according to the present invention, the positions of the hammer devices are not affected by the position of a movement or the like. Thus, as shown in FIG. 5, gong sticks 71, gong holder 72, and hammer devices 73 may be separately disposed in different positions of a case 74.

The total tone of the gong sticks can be adjusted with the variable resistor 23 that adjusts drive current supplied to the solenoid coils 6. When the resistors 21, which are connected to the respective bases of the transistors 22 are variable resistors, the tones of the gong sticks can be individually adjusted. The sound volume of each gong stick is more easily adjusted with current than with mechanical device.

In addition to the felt cushioning member, the rod hammers 5, which strike the gong sticks 2, can be prevented from rebounding by applying reverse voltage pulses just after drive voltage pulses or by properly adjusting the spring force.

It should be noted that the present invention can be applied to sound generators such as music boxes and chimes as well as time tone devices for clocks. When the present invention is applied to a music box or a chime, the time tone start signal HS becomes a sound start signal. Thus, the time counter and the down-counter shown in FIG. 3 can be omitted.

As described above, according to the present invention, since the hammer devices that strike the gong sticks are of solenoid type and the rod hammers are driven by the solenoid coils so that the rod hammers are disposed perpendicular to the direction of the gong sticks, real chime sound can be accomplished. In addition, since mechanical parts such as cams are not used, the size of the hammer devices can be reduced and the degree of freedom of the installation thereof can be increased.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A sound generator, comprising:

a gong holder secured to a resonance box;

a plurality of gong sticks aligned on said gong holder, respective lengths thereof differing from each other, each of said gong sticks having a first end and a second end, the first end being secured to said gong holder, the second end being a free end;

a plurality of hammer devices accommodated in a plastic case for striking respective said gong sticks, each of said hammer devices having a rod hammer movably disposed in a direction perpendicular to said gong stick and a solenoid member disposed around said rod hammer for driving said rod hammer; and current source means for supplying current to said solenoid members, wherein said plastic case is constructed of a lower lid and an upper lid, each of said lower lid and said upper lid having a plurality of grooves aligned in parallel with each other, the respective grooves forming cylindrical cavity portions where said hammer devices are accommodated, and said plastic case has a flange secured to said gong holder, a relative position between said flange and said gong holder being adjustable such that a distance between respective said rod hammers and said gong sticks is adjustable.

2. The sound generator according to claim 1, further comprising a cushioning spacer disposed between said flange and said gong holder and adapted for preventing vibration of said gong sticks from being transmitted to said hammer devices.

3. The sounding generator according to claim 1, wherein said current source means comprises;

a plurality of transistors for supplying the respective collector current to said solenoid coils corresponding to a designated mode; and a plurality of variable resistors, each variable resistor disposed between each said transistor and each solenoid member for controlling the value of said collector current to vary sound volume.

4. The sounding generator of claim 1 wherein said flange has a plurality of elongated slots aligned in parallel to said hammer devices for adjustment of the distance between the rod hammers and the gong sticks.

* * * * *